US007191835B2

(12) United States Patent
Howlett et al.

(10) Patent No.: US 7,191,835 B2
(45) Date of Patent: Mar. 20, 2007

(54) DISENGAGABLE BURR MILL

(75) Inventors: Paul David Howlett, Aberdeen (GB); George Telfer, Aberdeen (GB)

(73) Assignee: Specialised Petroleum Services Group Ltd., Aberdeen (GB)

( * ) Notice: Subject to any disclaimer, the term of this patent is extended or adjusted under 35 U.S.C. 154(b) by 266 days.

(21) Appl. No.: 10/493,009

(22) PCT Filed: Oct. 17, 2002

(86) PCT No.: PCT/GB02/04707

§ 371 (c)(1),
(2), (4) Date: Sep. 23, 2004

(87) PCT Pub. No.: WO03/036014

PCT Pub. Date: May 1, 2003

(65) Prior Publication Data

US 2005/0028982 A1 Feb. 10, 2005

(30) Foreign Application Priority Data

Oct. 20, 2001 (GB) ..... 0125306.1

(51) Int. Cl.
*E21B 21/00* (2006.01)

(52) U.S. Cl. ..... 166/311; 166/55.7; 166/66.5

(58) Field of Classification Search ..... 166/250.01, 166/311; 15/104.09, 104.13; 175/267, 269
See application file for complete search history.

(56) References Cited

U.S. PATENT DOCUMENTS

| | | | | |
|---|---|---|---|---|
| 1,764,373 | A | 6/1930 | Wells et al. | |
| 3,105,562 | A | 10/1963 | Stone et al. | |
| 5,293,945 | A | 3/1994 | Rosenhauch et al. | |
| 5,361,859 | A | 11/1994 | Tibbitts | |
| 6,615,933 | B1 * | 9/2003 | Eddison | 175/284 |

FOREIGN PATENT DOCUMENTS

| | | | |
|---|---|---|---|
| DE | 1012545 | A3 | 12/2000 |
| GB | 2352747 | A | 2/2001 |

* cited by examiner

*Primary Examiner*—David Bagnell
*Assistant Examiner*—Brad Harcourt
(74) *Attorney, Agent, or Firm*—C. Dean Domingue; Robert L. Waddell; Ted M. Anthony

(57) ABSTRACT

A downhole tool for use in the removal of burrs or other unwanted material from an inner surface of a pipeline, well casing or other tubular. The tool has a plurality of milling elements, which may be biased against the surface or retracted from the surface to disengage the tool from the tubular. A drop ball mechanism with a fluid by-pass is described for disengaging the milling elements.

14 Claims, 2 Drawing Sheets

DISENGAGABLE BURR MILL

CROSS-REFERENCE TO RELATED APPLICATIONS

Not Applicable.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

BACKGROUND OF THE INVENTION

The present invention relates to apparatus and method for use in oil and gas exploration and production, in particular, but not exclusively, to a burr mill for selectively performing milling and/or burr removal within a well.

When an oil or gas well is drilled it is common to insert a liner or casing into the well in order to support the walls as the depth of the well is increased. In order to access oil or gas containing formation outside the casing, the casing is commonly perforated by means of explosives. As the casing is made of a hardwearing material such as steel, when perforation takes place the steel casing is deliberately damaged to provide access from the wellbore through to the formation and as a result, sections of the casing will be left with exposed metal shards or burrs directed into the wellbore.

Consequently, the insertion of any other tools into the wellbore are susceptible to damage due to collisions with or scraping against the burrs formed during perforation. In particular, delicate screens used for the filtering of fluids downhole can easily be ruptured on contact with the burrs. It would therefore be advantageous to find a method of removing these burrs to avoid damaging tools downhole.

It is already known to attach a mill to a drill string and by rotation of the drill string through the wellbore, burrs may be removed. These tools have the disadvantage that once they have successfully milled off the burrs they become redundant within the well and if left in place they can both cause unwanted wear on the casing and be exerted to unwanted wear on the milling surfaces of the tool as they are subjected to continuous buffering on the inside diameter of the casing.

It is an object of at least one embodiment of the present invention to provide a downhole tool for the removal of burrs or other unwanted debris from inside a wellbore which obviates or mitigates disadvantages in the prior art.

It is an object of at least one embodiment of the present invention to provide a downhole tool in the form of a burr mill which is disengagable so that the milling elements can be removed from the surfaces on which the burrs occur.

BRIEF SUMMARY OF THE INVENTION

According to the first aspect of the present invention, there is provided a downhole tool for the removal of burrs and other unwanted material from an inside surface of a pipeline, well casing or other tubular, the tool including a tool body mountable on a work string, the body supporting a plurality of milling elements which mill the surface and retraction means for disengaging the milling elements from the surface when milling is no longer required.

Thus, the tool is capable of providing a milling action to remove burrs when the tool body is rotated on a drill string as it enters the well and at any location where the string requires to be circulated but no milling is required, the milling elements can be disengaged and retracted back into the tool to stop their contact with the inside surface of the casing or liner.

Preferably the tool includes biasing means to bias the one or more milling elements in an outward radial direction. Preferably the milling elements are biased into engagement with the inside surface. Advantageously the biasing means comprise springs held under compression. Preferably also the tool includes an outer sleeve, the outer sleeve including one or more apertures through which the milling elements protrude. More preferably the apertures include overhanging portions which engage a part of the milling element and limit the radial movement of the milling element. By limiting the radial movement of the milling elements the springs are held in compression.

Preferably the retraction means comprises release means to remove the compression on the springs. Advantageously the release means operates by re-positioning the springs relative to the tool body. The release means may comprise an inner sleeve mounted in a central bore of the tool body into which are located ends of the springs. The springs are re-positioned by virtue of movement of the inner sleeve from a first position in which the milling elements are engaged to the inside surface and a second position where the milling elements are disengaged.

Preferably the inner sleeve is held in the first position by at least one shear pin. More preferably the inner sleeve includes a ball seat into which a drop ball can locate. Once located a pressure build up behind the ball will force the ball against the drop inner sleeve until the shear pin shears and the inner sleeve falls into the second position.

Preferably the retraction means further includes one or more magnets. Preferably the magnets hold the milling elements against the tool body when disengaged.

Preferably also the tool includes a by-pass means which maintains fluid flow through the central bore by allowing fluid to by-pass the drop ball when the tool is disengaged. Advantageously the by-pass means comprises one or more radial ports in the inner sleeve and one or more recesses in the tool body. When the inner sleeve is in the second position, the one or more recesses are located adjacent the drop ball and one or more flow paths are created as the one or more ports align with the one or more recesses thereby directing fluid around the drop ball.

According to a second aspect of the present invention, there is provided a method of removing burrs or other unwanted debris from an inside surface of a pipeline, well casing or other tubular, the method comprising the steps:

a) inserting into the tubular one or more milling elements;
b) biasing the one or more milling elements against the surface to provide a milling action when the elements are moved in relation to the surface;
c) disengaging the one or more milling elements from the surface to prevent further milling.

Preferably the method further includes the step of actively retaining the milling elements in a retracted position away from the surface of the tubular.

Preferably step (c) includes the step of dropping a ball into the tool to cause parts thereof to move in relation to each other and thereby re-position springs within the tool.

More preferably the method includes the step of magnetically retaining the one or more milling elements against the tool body when disengaged.

BRIEF DESCRIPTION OF THE SEVERAL VIEWS OF THE DRAWINGS

An embodiment of the present invention will now be described by way of example only with reference to the accompanying Figures in which.

DETAILED DESCRIPTION OF THE INVENTION

Figure 1A:
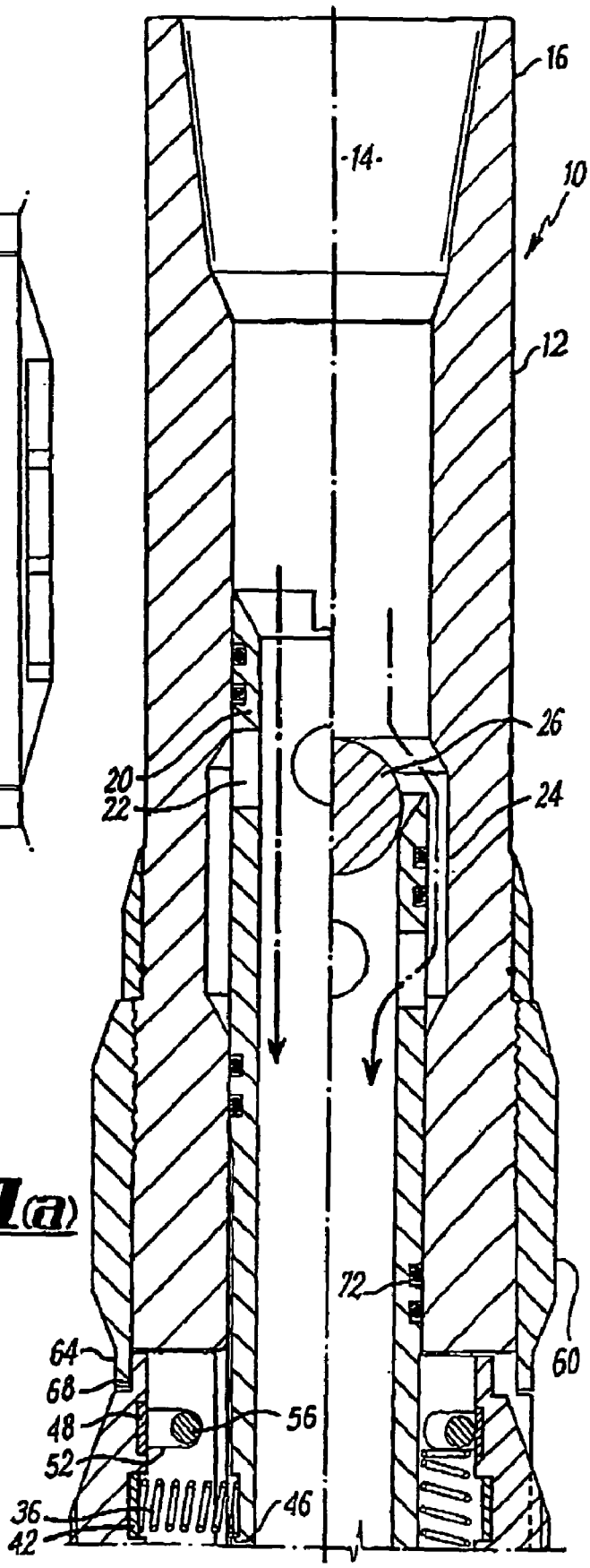
FIGS. 1 (*a*) and 1 (*b*) are a schematic cross-sectional view of a downhole tool in both an engaged (LHS) and disengaged (RHS) position in accordance with an embodiment of the present invention.
Figure 1B:
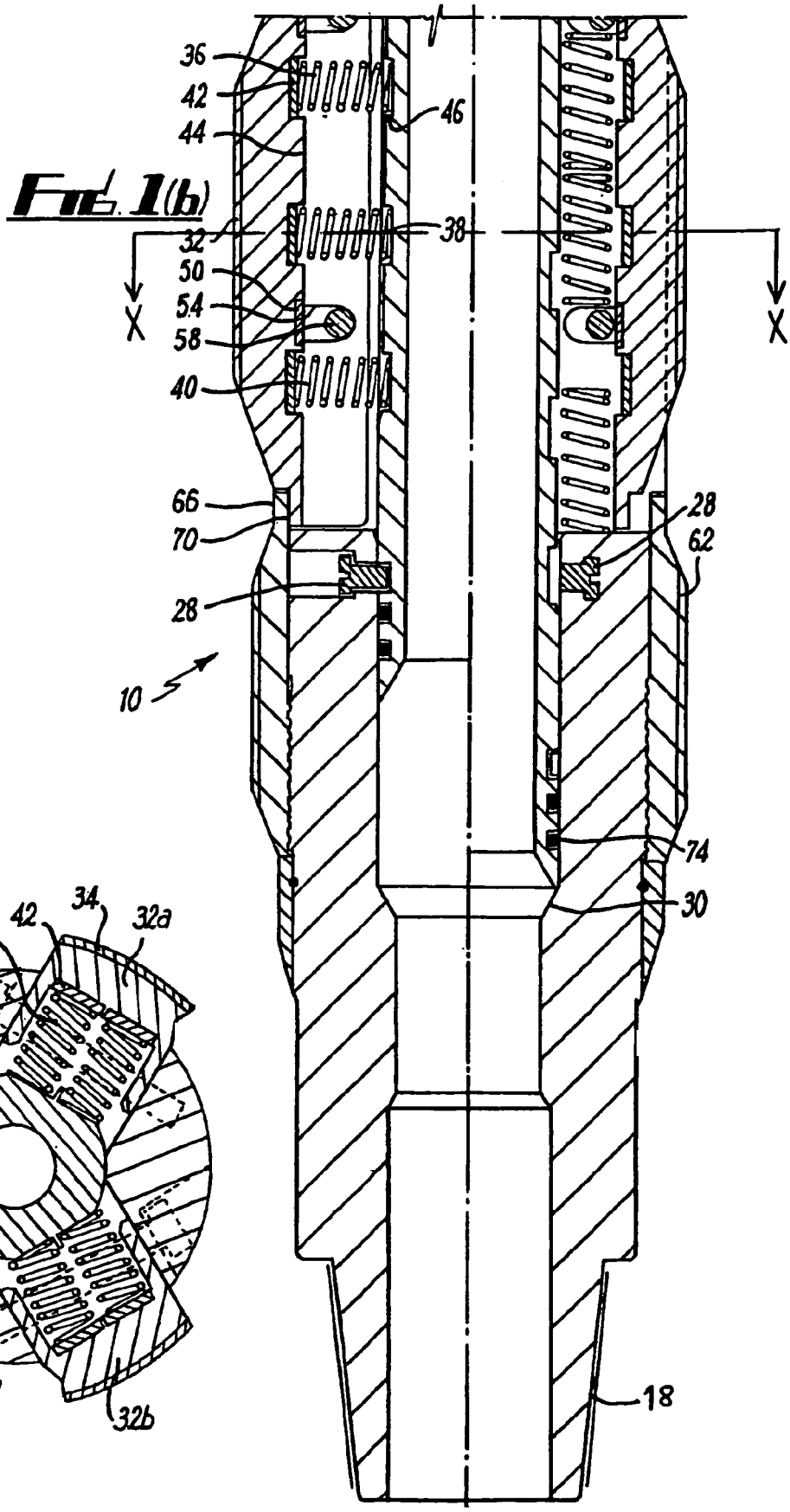

Reference is initially made to FIG. 1 of the drawings which depicts a downhole tool generally indicated by reference numeral 10 according to an embodiment of the present invention. Tool 10 includes a tool body 12 through which is axially located a central bore 14 for the passage of fluid through the tool 10. At an upper end of tool body 12 is located a box section 16 and at a lower end of tool body 12 there is located a threaded pin 18. Box section 16 and threaded pin 18 allow the tool 10 to be connected in a drill string (not shown).

Within the central bore 14 there is an inner sleeve 20. Inner sleeve 20 includes four ports 22 which when the sleeve is moved can locate across a recess 24 in the tool body 12 and provide an alternative flow path. This is illustrated in FIG. 1 at the upper end of the tool where the inner sleeve 20 has been moved by the action of a drop ball 26 being placed in the central bore 14. Inner sleeve 20 is kept initially in place by the use of shear screws 28. When ball 26 is dropped through the central bore 14, it lands on the ball seat at the upper end of inner sleeve 20. A fluid pressure build up behind ball 26 forces the ball 26 downwards with the result that the screws 28 shear under the force. Sleeve 20 then falls until it is prevented from exiting the lower end of the tool 10 by virtue of the lip 30.

Figure 3:
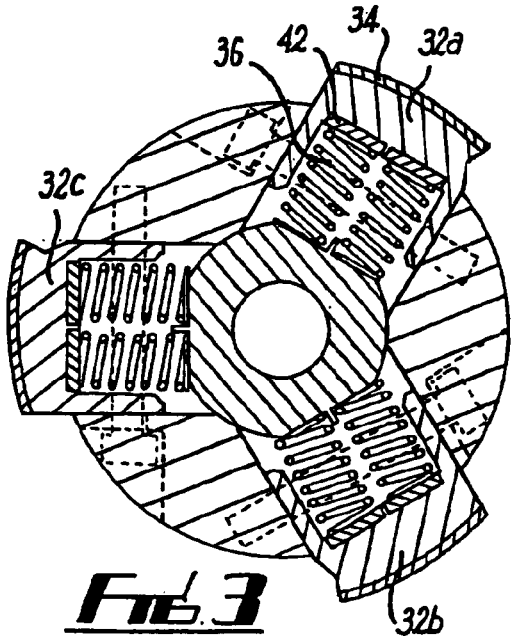
FIG. 3 is a sectional view through the line X—X of FIG. 1 (*b*).

Milling elements 32 are arranged around the tool body 12. In the embodiment shown there are three milling elements arranged equidistantly around the tool body as shown more clearly with the aid of FIG. 3.

Figure 2:
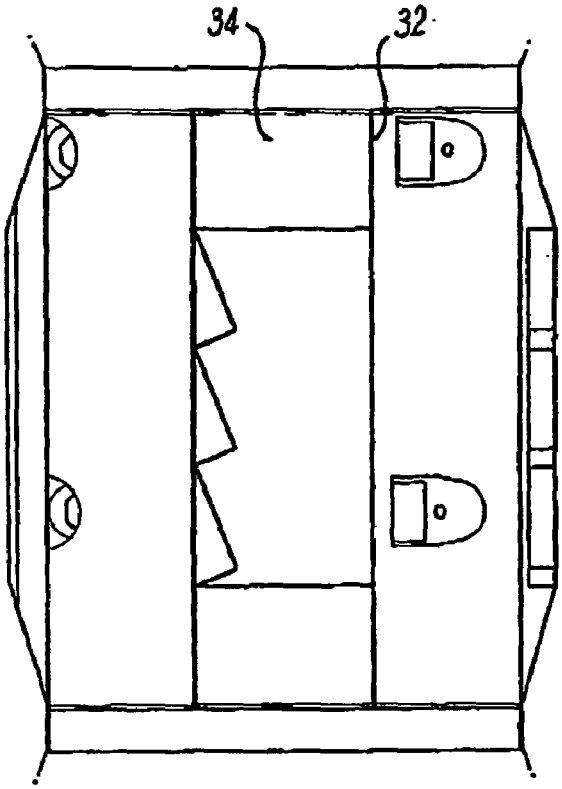
FIG. 2 is a [top] view of a milling element of the apparatus of FIG. 1.

Referring to FIG. 2, it is seen that each milling element has a milling surface which is arranged with projections to aid the milling action for the removal of burrs and other unwanted debris from the inside walls of the pipeline, liner or casing in use. Consequently, each milling surface 34 has a radial profile to provide a match to the pipeline wall (not shown). The milling elements 32 are not fixed to the tool body 12. The milling elements 32 are free-floating and are held in the extended position against the pipeline walls by virtue of springs 36, 38 and 40 located between the milling elements 32 and the inner sleeve 20. To aid the insertion of these springs 36, 38 and 40 when the tool is assembled, magnets 42 are located in recesses on a back surface 44 of the milling element wherein each spring 36, 38 and 40 locates in the recess and is held in place by the magnet 42. The opposing end of each spring 36, 38 and 40 is held in a narrow recess 46 on the inner sleeve 20. Also located on the back surface 44 of the milling element 32 are additional retraction magnets 48 and 50. Magnets 48 and 50 are located adjacent elongate ports 52 and 54 into which are located socket head cap screws 56 and 58 whose purpose will be described hereinafter.

Milling element 32 is limited in radial movement by stand off sleeves 60 and 62. Each stand off sleeve 60 and 62 has opposite handed threads thus in this embodiment stand off sleeve 60 has a left hand thread while stand off sleeve 62 has a right hand thread. Each sleeve 60 and 62 includes a lip 64, 66 which engages the corresponding lip 68, 70 on the milling element 32 to prevent the radial movement. Thus, milling element 32 is biased radially outwards by the use of the springs 36, 38 and 40. As better shown in FIG. 3, it will be appreciated that the springs 36 and magnets 42 may be paired up. Although those skilled in the art will appreciate that any number of milling elements may be used and the size and arrangement of the springs may be adjusted, as long as the overall effect is to bias the milling elements and in particular, the milling surfaces 34 outwardly.

In use the milling elements 32 are arranged on the tool body 12 in the configuration shown to the left hand side of FIG. 1. The tool 10 is attached to the drill string and the drill string rotated into the casing or liner. On entering the casing or liner the milling elements are in the expanded position by virtue of the springs 36, 38 and 40 radially biasing the milling surface 34 against the inner surface of the casing. The milling element 32 may move in relation to the diameter of the casing so that casing inner diameters of various sizes can be used with the tool. As the tool is rotated, burrs present on the inside wall of the casing will be dressed off and removed as will any other debris on the surface of the casing walls. When it is necessary to stop a de-burring or milling process but the drill string still requires to rotate to operate other tools which may be mounted thereon, a drop ball 26 is released into the central bore 14 of the tool. The drop ball 26 will typically be released at the surface and travel through the central bore of the drill string to enter the tool 10 at its location in the wellbore. Drop ball 26 will close the central bore 14 as it impacts on the inner sleeve 20. Fluid pressure will build up behind the ball 26 and the resulting force will cause the shear screws 28 to shear thereby allowing the inner sleeve 20 to fall towards the lower end of the tool. In falling the port 22 will locate over recess 24 in the tool body 12 so that flow is maintained through the central bore 14 of the tool 10. At the location of the milling elements 32, movement of the inner sleeve 20 will cause the springs 36, 38 and 40 to be re-positioned longitudinally with respect to the tool body 12. Narrow recesses 36 will ensure that the end of the springs 36, 38 and 40 and located in the narrow recess 46 will be forced downwards which will release the opposing end of each spring 36, 38 and 40 from the magnet 42. Once the springs 36, 38 and 40 have been re-positioned, the milling element 32 will be pulled radially inwards by the action of the magnets 42 against the re-positioned springs 36, 38 and 40 with the result that the milling element 32 will be pulled to a retracted position away from the walls of the casing. Milling element 32 will be held in the retracted position by virtue of the retraction magnets 48 and 50 remaining attached and attracting the socket head cap screws 56 and 58. Thus, in the disengaged position the milling elements 32 are held against the tool body 12 and the milling operation is stopped. In order to prevent passage of fluid into the region where the springs 36, 38 and 40 and magnets 42, 48 and 50 are located, the inner sleeve 20 includes a series of 'O' rings 72 and 74.

The principle advantage of the present invention is that it provides a milling tool where the milling elements can be disengaged to reduce wear on the elements and on the casing walls in use.

It is a further advantage of the present invention that the milling elements are held against the tool body when the tool is disengaged.

Various modifications may be made to the invention described hereinbefore without departing from the scope thereof. For instance, the number and arrangement of milling elements may be varied as long as they are mounted around the tool body and have a milling rib or profile to interact with a surface of the inner wall of the casing. Additionally, there may be more than one set of milling ribs located longitudinally which can be operated by a single ball drop. It will also be appreciated by those skilled in the art that a number of these tools may be mounted in relation to each other on a drill string each being operated separately by means of different sized drop balls. Thus, the lowest positioned tool would have a small inner sleeve so that the drop ball would be small enough to fall through the central bore and inner sleeve of the milling tools placed above it.

The invention claimed is:

1. A downhole tool for the removal of burrs and other unwanted material from an inside surface of a pipeline, well casing or other tubular, the tool including a tool body mountable on a work string, the body supporting a plurality of milling elements which mill the surface, biasing means to bias the plurality of milling elements in an outward radial direction by springs held under compression and retraction means for disengaging the milling elements from the surface by repositioning of the springs when milling is no longer required.

2. A downhole tool as claimed in claim 1 wherein the tool further includes an outer sleeve, the outer sleeve including one or more apertures through which the milling elements protrude.

3. A downhole tool as claimed in claim 2 wherein the apertures include overhanging portions which engage a part of the milling element and limit the radial movement of the milling element.

4. A downhole tool as claimed in claim 1 wherein the retraction means comprises release means to remove the compression on the springs.

5. A downhole tool as claimed in claim 4 wherein the release means comprises an inner sleeve mounted in a central bore of the tool body into which are located ends of the springs such that the springs are re-positioned by virtue of movement of the inner sleeve from a first position in which the milling elements are engaged to the inside surface and a second position where the milling elements are disengaged.

6. A downhole tool as claimed in claim 5 wherein the inner sleeve is held in the first position by at least one shear pin.

7. A downhole tool as claimed in claim 6 wherein the inner sleeve includes a ball seat into which a drop ball can locate such that a pressure build up behind the ball will force the ball against the inner sleeve until the shear pin shears and the inner sleeve falls into the second position.

8. A downhole tool as claimed in claim 4 wherein the retraction means further includes one or more magnets to hold the milling elements against the tool body when disengaged.

9. A downhole tool as claimed in claim 7 wherein the tool includes a by-pass means which maintains fluid flow through the central bore by allowing fluid to by-pass the drop ball when the tool is disengaged.

10. A downhole tool as claimed in claim 9 wherein the by-pass means comprises one or more radial ports in the inner sleeve and one or more recesses in the tool body such that when the inner sleeve is in the second position, the one or more recesses are located adjacent the drop ball and one or more flow paths are created as the one or more ports align with the one or more recesses thereby directing fluid around the drop ball.

11. A method of removing burrs or other unwanted debris from an inside surface of a pipeline, well casing or other tubular, the method comprising the steps:

a) inserting into the tubular one or more milling elements;

b) biasing the one or more milling elements against the surface by use of springs to provide a milling action when the elements are moved in relation to the surface;

c) disengaging the one or more milling elements from the surface by repositioning the springs to prevent further milling.

12. A method as claimed in claim 11 wherein the method further includes the step of actively retaining the milling elements in a retracted position away from the surface of the tubular.

13. A method as claimed in claim 11 wherein step (c) includes the step of dropping a ball into the tool to cause parts thereof to move in relation to each other and thereby re-position the springs.

14. A method as claimed in claim 11 wherein the method includes the step of magnetically retaining the one or more milling elements against the tool body when disengaged.

* * * * *